US006534701B2

(12) United States Patent
Isozaki

(10) Patent No.: US 6,534,701 B2
(45) Date of Patent: Mar. 18, 2003

(54) MEMORY CARD WITH MUSIC PERFORMANCE FUNCTION

(75) Inventor: Yoshimasa Isozaki, Hamakita (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/022,886

(22) Filed: Dec. 17, 2001

(65) Prior Publication Data

US 2002/0073828 A1 Jun. 20, 2002

(30) Foreign Application Priority Data

Dec. 19, 2000 (JP) ..... 2000-385103

(51) Int. Cl.[7] ..... G10H 1/06; G10H 1/26; G10H 7/00

(52) U.S. Cl. ..... 84/609; 84/622

(58) Field of Search ..... 84/609–614, 622–625, 84/634–638

(56) References Cited

U.S. PATENT DOCUMENTS 5,672,837 A * 9/1997 Setoguchi et al. ..... 84/609
5,734,118 A * 3/1998 Ashour et al. ..... 84/609
5,861,567 A * 1/1999 Hirano ..... 84/609
5,986,200 A * 11/1999 Curtin ..... 84/609
6,166,316 A * 12/2000 Takahashi et al. ..... 84/636 X
6,184,455 B1 * 2/2001 Tamura ..... 84/625
6,201,178 B1 * 3/2001 Shinsky ..... 84/613
6,303,852 B1 * 10/2001 Kizaki et al. ..... 84/622

FOREIGN PATENT DOCUMENTS

JP 2000-112824 4/2000

* cited by examiner

*Primary Examiner*—Stanley J. Witkowski
(74) *Attorney, Agent, or Firm*—Morrison & Foerster LLP

(57) ABSTRACT

A functional storage module is removably connectable to an electronic apparatus as a storage medium of data. The module is composed of a memory core block, a sequencer block and a tone generator block. The memory core block stores various data including-music performance data for use in the electronic apparatus. The sequencer block retrieves the music performance data from the memory core block, and sequentially outputs instructions for synthesis of music tones according to the retrieved music performance data. The tone generator block operates in response to the instructions for carrying out the synthesis of the music tones, thereby outputting waveform data representative of the music tones to the electronic apparatus.

18 Claims, 7 Drawing Sheets

FIG.2A

CONTROL FILE

| |
|---|
| PLAY |
| PAUSE |
| STOP |
| FF |
| REW |
| • • • |
| ↓ |
| |

FIG.2C

SETUP FILE

| |
|---|
| VOLUME |
| TEMPO |
| KEY |
| |
| |
| FILENAME1 |
| FILENAME2 |
| ↓ |
| |
| |
| |
| |

FIG.2B

OUTCONT FILE

| |
|---|
| READYFLG |
| (WAVEFILE) |

FIG.3A

DIRECTORY INFORMATION

| FILE NAME | EXTENSION | FIRST CLUSTER |
|---|---|---|
| | | |
| | | |
| WAVEBUF0 | | 2 |
| | | |
| WAVEBUF1 | | 5 |
| | | |

FIG.3B

DIRECTORY INFORMATION (ANOTHER EMBODIMENT)

| | | |
|---|---|---|
| | | |
| WAVEBUF | 000 | 2 |
| | | |
| WAVEBUF | 001 | 5 |
| | | |

FIG.3C

| ENTRY NUMBER | FAT |
|---|---|
| 0 | |
| 1 | |
| 2 | 3 |
| 3 | 4 |
| 4 | 7 |
| 5 | 6 |
| 6 | 9 |
| 7 | EOF |
| 8 | 0 |
| 9 | 10 |
| 10 | EOF |
| 11 | |
| 12 | |
| 13 | |
| 14 | |

FIG.3D

| CLUSTER NO. | DATA REGION |
|---|---|
| 2 | FIRST CLUSTER OF WAVEBUF0 |
| 3 | SECOND CLUSTER OF WAVEBUF0 |
| 4 | THIRD CLUSTER OF WAVEBUF0 |
| 5 | FIRST CLUSTER OF WAVEBUF1 |
| 6 | SECOND CLUSTER OF WAVEBUF1 |
| 7 | LAST CLUSTER OF WAVEBUF0 |
| 8 | EMPTY REGION |
| 9 | THIRD CLUSTER OF WAVEBUF1 |
| 10 | LAST CLUSTER OF WAVEBUF1 |
| 11 | |
| 12 | |
| 13 | |
| 14 | |
| | |
| | |

FIG.3E

| CLUSTER NO. | DATA REGION (ANOTHER EMBODIMENT) |
|---|---|
| 2 | FIRST CLUSTER OF WAVEBUF.000 |
| 3 | SECOND CLUSTER OF WAVEBUF.000 |
| 4 | THIRD CLUSTER OF WAVEBUF.000 |
| 5 | FIRST CLUSTER OF WAVEBUF.001 |
| 6 | SECOND CLUSTER OF WAVEBUF.001 |
| 7 | LAST CLUSTER OF WAVEBUF.000 |
| 8 | EMPTY REGION |
| 9 | THIRD CLUSTER OF WAVEBUF.001 |
| 10 | LAST CLUSTER OF WAVEBUF.001 |
| 11 | |
| 12 | |
| 13 | |
| 14 | |
| | |
| | |

MEMORY CARD WITH MUSIC PERFORMANCE FUNCTION

BACKGROUND OF THE INVENTION

The present invention relates to a storage device such as memory cards equipped with an MIDI sequencer and a tone generator.

There have been conventionally known such a variety of devices including computers, audio players, and portable telephones that can use various memory cards as a storage medium thereof. Such memory cards may include, for example, an SD (Secure Digital) memory card (which is the name of a media card cooperatively developed by Toshiba, Matsushita Denki, and SANDISK U.S.A.) and a memory stick (which is the trade name of Sony). Some of those memory cards are provided with so-called a copyright-protection mechanism for preventing an unauthorized access other than accesses by an authorized apparatus to information appropriately stored on the memory card.

On the other hand, a computer or its adaptable apparatus requires an MIDI sequencer (sequencer software) and a tone generator device to perform or reproduce MIDI music performance data. The memory card can only store music information and so cannot have an MIDI musical-performance function if it is alone.

As mentioned above, a variety of memory cards can be used as a storage medium in various apparatuses but has been required to additionally have a connectable accessory such as an MIDI sequencer or a tone generator device in order to realize the MIDI musical-performance function.

SUMMARY OF THE INVENTION

It is an object of the present invention to provide a storage device such as a memory card which needs only to be connected to its accommodating apparatus in order to add function of MIDI musical performance.

To this end, one aspect of the present invention provides a functional storage module being removably connectable to an electronic apparatus as a storage medium of data. The module comprises a memory core block that stores various data including music performance data for use in the electronic apparatus, a sequencer block that retrieves the music performance data from the memory core block and that sequentially outputs instructions for synthesis of music tones according to the retrieved music performance data, and a tone generator block that operates in response to the instructions for carrying out the synthesis of the music tones, thereby outputting waveform data representative of the music tones to the electronic apparatus.

Another aspect of the present invention provides a functional storage module being removably connectable to an electronic apparatus as a removable storage medium of data. The module comprises a memory core block that stores various data including music performance data for use in the electronic apparatus, the various data being stored in the form of files including a control file, a controller block that operates when the electronic apparatus has written control data into the control file, for retrieving the control file from the memory core block to read the written control data, a sequencer block that operates when the read control data designates music performance data and indicates reproduction thereof, for retrieving the designated music performance data from the memory core block, and for sequentially outputting instructions for synthesis of music tones according to the retrieved music performance data, and a tone generator block that operates in response to the instructions for carrying out the synthesis of the music tones, thereby outputting waveform data representative of the music tones to the electronic apparatus.

Preferably, the sequencer block operates when the control data indicates a control of the reproduction selected from a re-start, a stop, a fast feed, a rewind and a pause, for effecting the indicated control during the course of the reproduction of the music performance data.

BRIEF DESCRIPTION OF THE DRAWINGS

FIGS. 2A–2C are an illustration showing a configuration of a control file, an output control file, and a setup file.

FIGS. 3A–3E are illustrations showing configuration examples of storing directory information, FAT information, and data region respectively in a memory core.

DETAILED DESCRIPTION OF THE INVENTION

The following will describe embodiments of the present invention with reference to the drawings.

Figure 1:
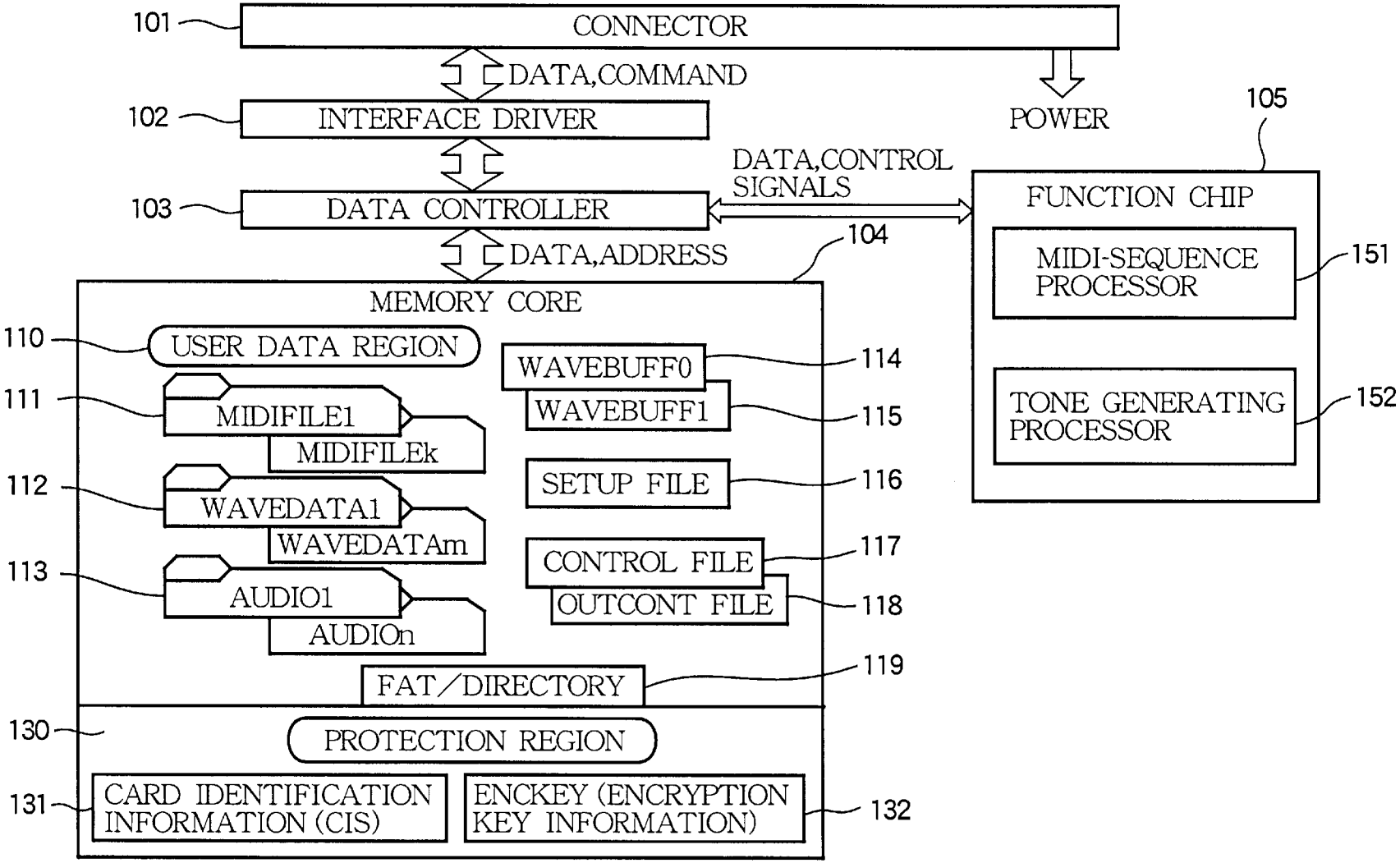
FIG. 1 is a block diagram showing a memory card having a tone generator according to an embodiment of the present invention.

FIG. 1 shows a block configuration of a memory-card tone generator (tone generator-equipped storage device) related to an embodiment of the present invention. This memory-card tone generator includes a connector 101, an interface driver 102, a data controller 103, a memory core 104, and a function chip 105. The connector 101 is a connection terminal section for connecting this memory card to a variety of apparatuses. The interface driver 102 is an interface section for transferring to the data controller 103 a command input from the outside via the connector 101 and data input and output between this tone generator and an external apparatus. Note here that this memory card transfers data between this device and an external apparatus in so-called block transfer. That is, the file is read or written in block units when a file name thereof is specified together with a read/write instruction. The data controller 103 controls the read/write operation to the memory core 104 as well as the transfer of data and a control signal between the memory core 104 and the function chip 105.

The file write commands given to this memory card are divided into a copyright-protected writing type and a copyright-unprotected writing type. For copyright-protected writing, the data controller 103 performs predetermined encryption processing on various files requiring protection based on a later-described encryption key, and stores them in the memory core 104. When any encrypted one of the files is read out, the data controller 103 conducts authentication with the apparatus side, and if it is confirmed that the file should be decrypted, the memory device decrypts the file and transfers the file to the apparatus. If the file is a common one and has not been encrypted, the memory device reads out the file as it is and transfers it to the apparatus. Note here that the copyright may be protected by the memory card according to an already known method.

The memory core 104 is a storage section for storing a variety of types of information. The memory core 104 is divided into a user data region 110 and a protection region 130.

The protection region 130 cannot be referenced nor accessed by the user usually, storing card identification information (CIS: card information structure) 131 used to identify a memory card type and mode, data format and encryption key information (ENCKEY) 132 used to encrypt data. The system references the card identification information 131 to decide whether the relevant card is authorized, or uses the encryption key information 132 to protect data stored on the card.

The user data region 110 is managed by a FAT (file allocation table) file system generally used in a recent personal computer or other computer system. That is, the user data region 110 is subdivided into a plurality of sectors (clusters) each having a predetermined number of bytes (e.g., 512 bytes), and a directory region 119 stores a list of FAT referencing destinations (which indicate FAT positions which store file's top cluster numbers) corresponding to file names. Therefore, to read out a file, the FAT is referenced from a portion corresponding to this file in the directory, and then the FAT is traced to the end of the file to thereby read out clusters sequentially. To write data in a file, similarly, the FAT is traced to write data in cluster units sequentially.

The user data region 110 stores an MIDI file group 111, a WAVE data group 112, and an audio data group 113. The MIDI file group 111 is comprised of MIDI files, each of which consists of a plurality of MIDI events (MIDI messages). The WAVE data group 112 is comprised of WAVE data files, each of which consists of waveform sample data of various timbres, which may be read out when a later-described tone generator section 152 generates a musical tone.

The user data region 110 reserves a WAVE buffer (114) and another WAVE buffer (115). Those two WAVE buffers store data of a musical tone when it is generated by the later-described function chip 105, serving as a buffer for transferring generated musical-tone data between the system and an external apparatus. Also, the user data region 110 stores a setup file (SETUP FILE) 116, a control file (CBNTROL FILE) 17, and an output control file (OUTCONT FILE) 118. The setup file 116 is used to specify musical-performance conditions (sound volume, tempo, and tune) and a music piece to be performed (file name), the contents of which are reloaded by user setting/selection. The control file 117 is used to control musical performance such as start, stop, forward feed, and rewind of the musical performance, the contents of which may be rewritten by a user's instruction or operation. The output control file 118 is used to control read-out of waveform data of a music piece being performed, the contents of which are accessed by an external apparatus to read out the waveform data of the music piece for reproduction (digital/analog conversion).

The function chip 105 has an MIDI sequence processor (hereinafter called MIDI sequencer) 151 and a tone generating processor (hereinafter called tone generator section) 152. The function chip 105 is integrally packaged in the memory card. The MIDI sequencer 151 reads out through the data controller 103 the contents of the setup file 116 and the control file 117 and also the MIDI file 111 and the WAVE data 112 which is specified, thus controlling the tone generator section 152. The tone generator section 152 sequentially receives a performance event upon start of the performance processing by the MIDI sequencer 151 to then generate a musical-tone waveform sample, and writes the same as a musical-tone waveform file into a WAVE buffer 0 or 1. The external apparatus sequentially reads out those musical-tone waveform files according to the contents of the output control file 118, and performs analog/digital conversion on the thus read data for sound generation.

In this embodiment, the tone generator section 152 alternately updates and generates two musical-tone waveform files of the WAVE buffer 0 (WAVEBUF0) and the WAVE buffer 1 (WAVEBUF1) of the user region 110 of the memory core 104, in a so-called double-buffer mode. That is, when the tone generator section 152 is creating a musical-tone waveform into the WAVE buffer 0, the external apparatus reads out another musical-tone waveform from the WAVE buffer 1 and, conversely when the tone generator section 152 is writing the waveform into the WAVE buffer 1, the external apparatus reads out the waveform from the WAVE buffer 0. This operation is repeated to output consecutively musical-tone waveforms. Note here that the system may have three buffers or more or may have a single buffer if the system has a sufficiently high processing rate.

FIG. 2A shows a configuration of the control file 117. The control file 117 has flag storage regions for storing a PLAY flag, a PAUSE flag, a STOP flag, and a REW flag. Each of those flags is ON if it is set at 1, and OFF if it is set at 0. The external apparatus sets those flags as it desires, and writes those settings as the control file 117 onto the memory card. Thus, for example, by turning ON the PLAY flag, the PAUSE flag, the STOP flag, the FF flag, or the REW flag, the external apparatus can provide this memory card with an instruction of reproducing, pausing, stopping, forward feeding, or rewinding, respectively. Note here that the control file 117 is read and written by indexing a file name according to a predetermined rule.

FIG. 2B shows a configuration of the output control file 118. The output control file 118 has a ready flag READYFLG and a wave buffer name indicating region WAVEFILE. This output control file 118 (which is supposed to have a file name according to the rule) is referenced by the external apparatus when the apparatus reads out musical-tone waveform data from this memory card. If the READY flag is ON (READYFLG=1) when this output control file has been read out, it means that a musical-tone waveform file can be read out from a WAVE buffer specified by the wave buffer name indicating region WAVEFILE.

FIG. 2C shows a configuration of the setup file 116. The setup file 116 is used to store the information of an arrangement of the file names of the MIDI file group 111 as well as the information of sound volume, tempo, and tune employed when an MIDI file having a specified MIDI file name among of those file names is reproduced.

FIGS. 3A–3E indicate storage examples in the core memory 104, such as the directory information region, the FAT region, and the data region. FIG. 3A shows an example of the contents of directory information. In this directory information region is registered the WAVE buffer 0 (having a file name of WAVEBUF0), and the top cluster number which is set at "2". As shown in FIG. 3D, therefore, the first cluster of the WAVEBUF0 is located where the data region's cluster number is "2". Also, since "3" is set at a referenced position where the FAT region's entry number is "2" in FIG. 3C, the next cluster has a cluster number "3". Hereafter the FAT region of FIG. 3C can be traced in such a manner as to acquire the clusters of this file sequentially. If an EOF (End of File) appears in the FAT region, this file ends there. Also, a cluster where "0" is set in the FAT region is empty. This holds true also with the WAVEBUF1.

FIG. 3B shows an example where two WAVE buffers have the same file name but different extensions. FIG. 3E shows the corresponding data region.

Figure 4:
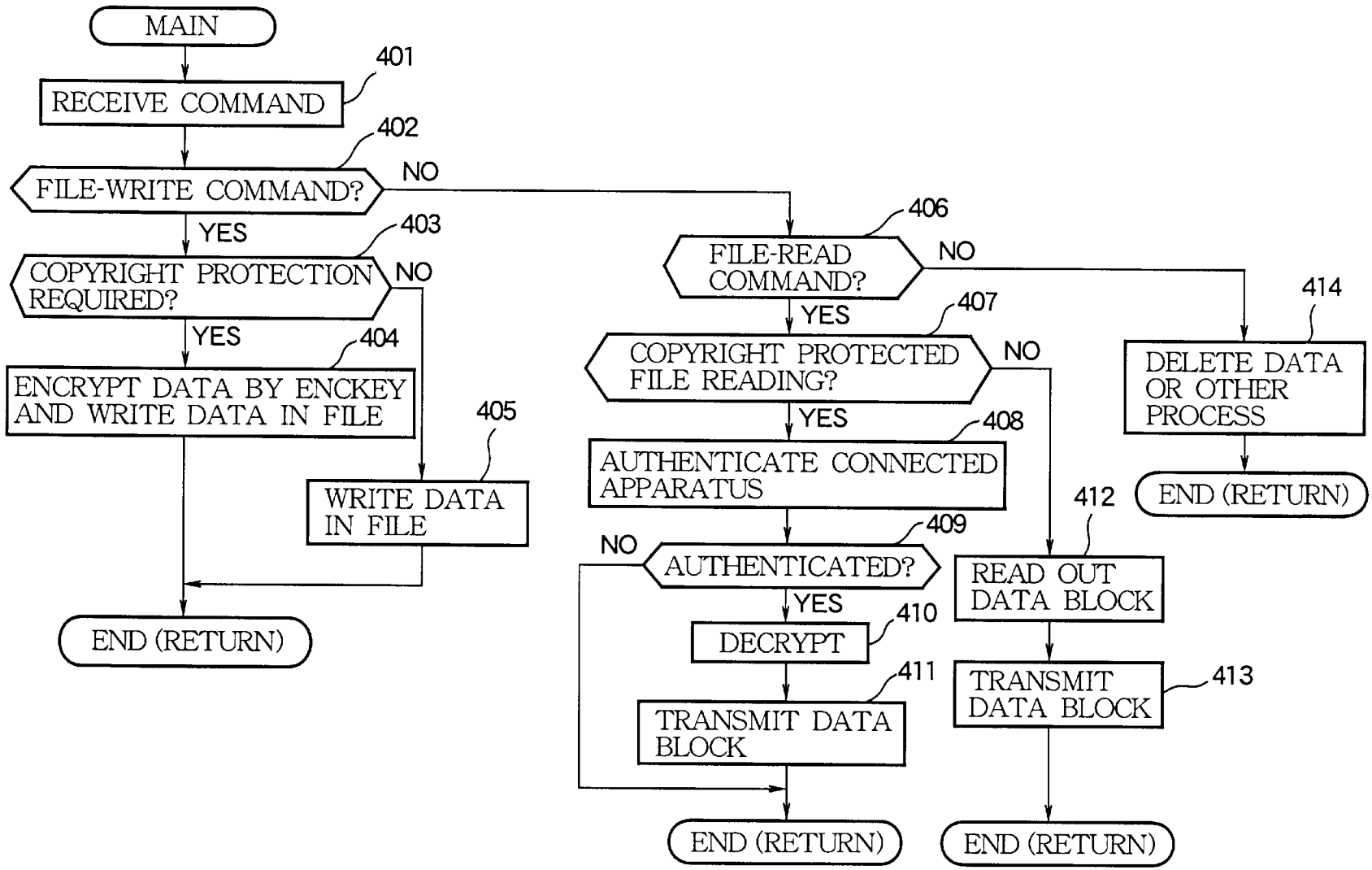
FIG. 4 is a flowchart showing a procedure of a data controller.

FIG. 4 is a flowchart showing a procedure of processing by the data controller 103. The data controller 103 receives a command from the external apparatus at step 401 to then decide whether the received command is a file write command at step 402. If it is the file write command, the data controller 103 decides whether the file needs copyright protection at step 403. If the file needs copyright protection, the data controller 103 uses the encryption key information 132 at step 404 to encrypt and write data into the user region 110 of the memory core 104. If it is decided not to need copyright protection at step 403, the data controller 103 writes the file as it is at step 405. In this writing, the FAT is edited and updated correspondingly so that the FAT can manage the current situation of the files in the memory core 104. After steps 404 and 405, the process ends.

If the relevant command is decided not to be a file write command at step 402, the data controller 103 decides whether the received command is a file read command at step 406. If it is decided to be the file read command, the data controller 103 decides whether it is a read command of a copyright-protection file at step 406. If it is decided so, the data controller 103 conducts authentication between the memory card and the externally connected apparatus at step 408, and then decides whether the command is authenticated at step 409. If it is authenticated, the data controller 103 decrypts data at step 410 and then transmits data to the external apparatus connected thereto at step 411. If it is not authenticated at step 409, the data controller 103 ends the process immediately. Note here that the decryption processing at step 410 may not be performed, and instead may transfer the key with the file as encrypted after mutual authentication. In this case, the file may be decrypted on the side of the system of the connected apparatus which has read out the file. If it is decided not to be a read command of a copyright-protection file at 407, the data controller 103 reads out the file as a block by block at step 412 and then transmits the data blocks to the external apparatus connected thereto at step 413.

If the received command is decided not to be a file read command at step 406, the data controller 103 performs other processing such as data deletion according to the command at step 414 and then ends the process.

Figure 5:
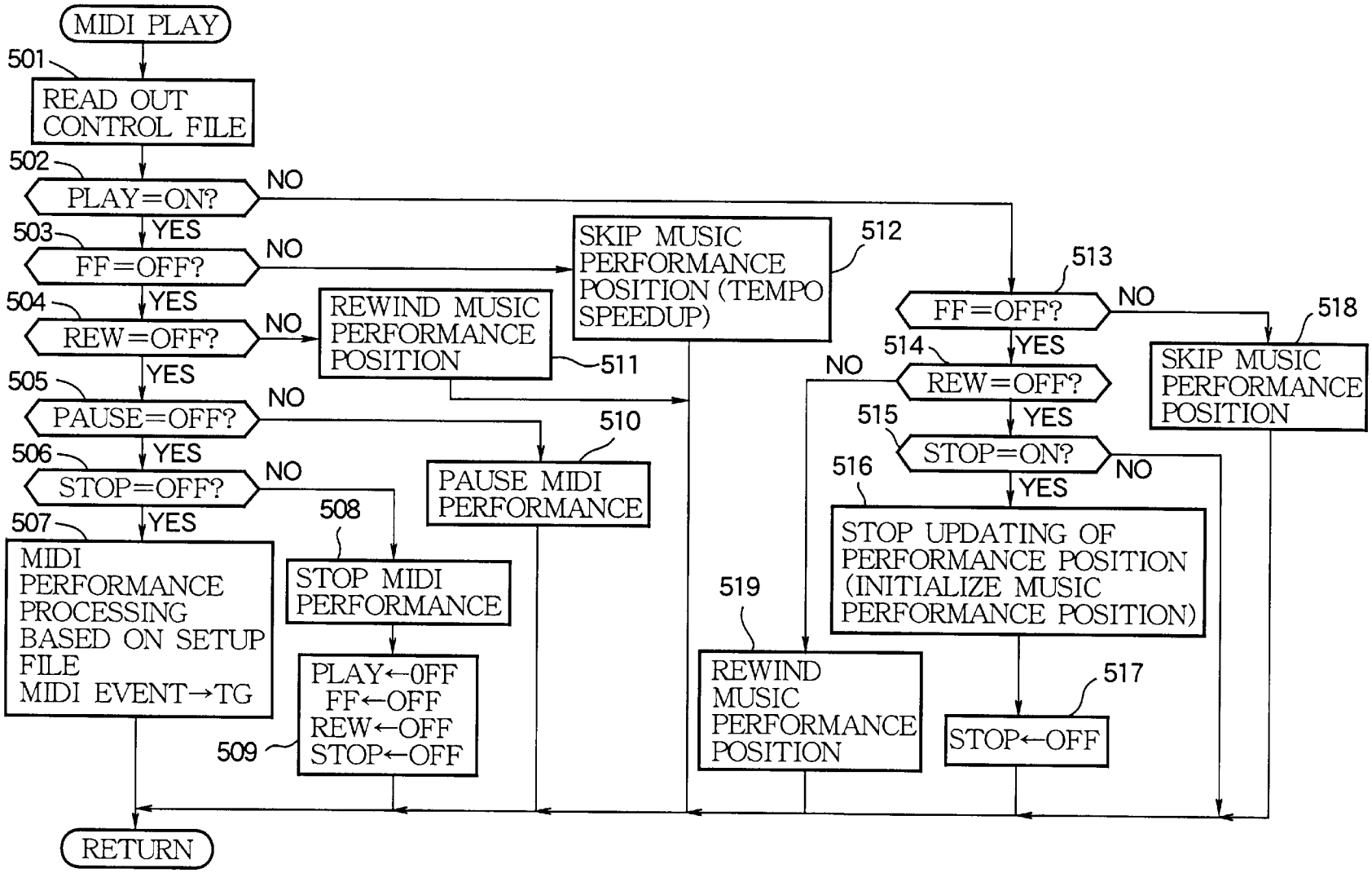
FIG. 5 is a flowchart showing a procedure of an MIDI sequencer.

FIG. 5 is a flowchart showing a procedure of processing by the MIDI sequencer 151. This processing is repeated at a predetermined time interval when the MIDI sequencer 151 is started.

First at step 501, the MIDI. sequencer 151 reads out the control file 117. At step 502, the sequencer decides whether the PLAY flag of the control file is ON. If it is ON, the MIDI sequencer 151 goes to step 503 and, otherwise, to step 513. At step 503, the sequencer decides whether the FF flag is OFF. If it is OFF, the MIDI sequencer 151 goes to step 504 and, otherwise, to step 512. At step 504, the sequencer decides whether the REW. flag is OFF. If it is OFF, the MIDI sequencer 151 goes to step 505 and, otherwise, to step 511. At step 505, the sequencer decides whether the PAUSE flag is OFF. If it is OFF, the MIDI sequencer 151 goes to 506 and, otherwise, to step 510. At step 506, the sequencer decides whether the STOP flag is OFF. If it is OFF, the MIDI sequencer 151 goes to step 507 and, otherwise, to step 508.

At step 507, where the reproduction is instructed and other operations of forward feed, rewind, pause, and stop are not instructed, the sequencer performs MIDI performance processing based on the contents of the setup file 116. In this case, MIDI events of an MIDI file read out according to the setup file is sent to the tone generator section 152. After step 507, the MIDI sequencer 151 returns.

If the PLAY flag is OFF at step 502, the sequencer decides whether the FF flag is OFF at step 513. If the FF flag is ON to mean that a forward feed operation is specified in a non-reproduction state, the sequencer skips a performed music-piece position at step 518 and then returns. If the FF flag is OFF at step 513, the sequencer decides whether the REW flag is OFF at step 514. If the REW flag is ON to mean that a rewind operation is specified in a non-reproduction state, the sequencer performs a rewind operation to the performed music-piece position at step 519 and then returns. If the REW flag is OFF at step 514, the sequencer decides whether the STOP flag is ON at step 515. IF the STOP flag is OFF, the routine returns directly. If the STOP flag is ON to mean that a stop instruction is given again in a non-reproduction state, the sequencer stops updating of the performance position (i.e., re-start processing for initializing the performance position) at step 516. Then, the sequencer turns OFF the STOP flag at step 517 and then returns.

If the FF flag is ON at step 503 to mean that a forward feed operation is specified in a reproduction state, the sequencer feeds forward the performance position (speeds up the tempo) at step 512 and then returns. If the REW flag is ON at step 504 to mean that a rewind operation is specified in a reproduction state, the sequencer performs a rewind operation to the performance position at step 511 and then returns. If the PAUSE flag is ON at step 505 to mean that a pause operation is instructed in a reproduction state, the sequencer pauses the MIDI performance at step 510 and then returns. If the STOP flag is ON at step 506 to mean that a stop operation is specified in an reproduction state, the sequencer stops the MIDI performance at step 508 and turns all the flags at step 509 and then returns.

Figure 6:
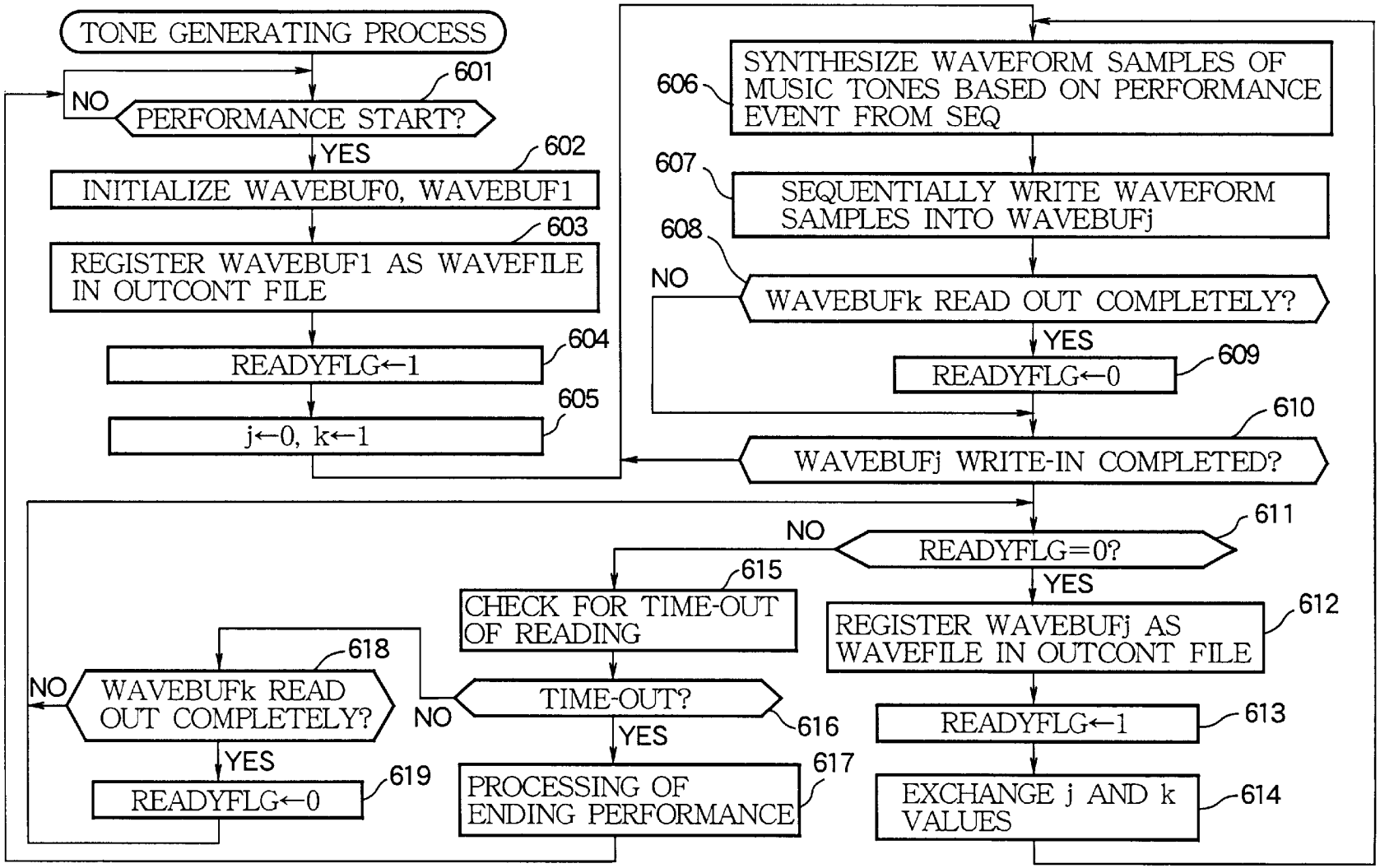
FIG. 6 is a flowchart showing a procedure of a tone generator.

FIG. 6 is a flowchart showing a procedure of processing by the tone generator section 152. First at step 601 the tone generator section 152 decides whether a performance start instruction is received from the MIDI sequencer 151. If the start instruction is not received yet, the tone generator 152 repeats the decision. If a performance start instruction is received, the generator initializes the WAVE buffers 0 and 1 at step 602. At step 603, the generator registers the WAVE buffer 1 in the wave buffer name indicating region WAVE-FILE of the output control file 118. At step 604, the generator sets the READY flag of the output controller file 118 at 1 and, at step 605, sets a variable j at 0 and a variable k at 1.

Next at step 606, the generator synthesizes a tone waveform sample based on a. performance event sent from the MIDI sequencer 151. At step 607, the generator sequentially writes the thus synthesized tone waveform samples into the WAVE buffer J. At step 608, the generator decides whether the external apparatus connected to the system has completely read out the WAVE buffer k. If the decision is positive, the generator sets the READY flag at 0 and goes to step 610. If the decision is negative, the routine goes to step 610 directly.

At step 610, the generator decides whether write-in to the WAVE buffer j is completed, i.e. whether the WAVE buffer j is full of the synthesized tone waveform samples. If the write-in is not completed yet, the routine returns to step 606.

If the write-in is completed already, the generator decides whether the READY flag is 0 at step 611. If the flag is 0 to mean that the external apparatus has completely read out the WAVE buffer k, the generator registers the WAVE buffer j newly as a WAVEFILE in the output. control file 118 at step 612, and then sets the READY flag at 1 at step 613 and exchanges values of j and k with each other at step 614 and then returns to step 606.

If the READY flag is not 0 at step 611 to mean that the WAVE buffer k is not completely read out, the generator checks for read time-out at step 615 and decides whether the read-out operation has expired at step 616. If the read-out operation has not expired yet, the generator decides whether the WAVE buffer k is read out completely at step 618 and, if the generator decides negative, the routine returns to step 611. If the WAVE buffer k is read out completely, the generator sets the READY flag at 0 at step 619 and then returns to step 611. If the read-out operation has expired at step 616, the generator ends performance at step 617 and then returns to step 601.

If an instruction is given to stop the MIDI performance at step 508 during processing of the MIDI sequencer 151 shown in FIG. 5, the tone generator section 152 stops the performance and then returns to step 601.

Figure 7:
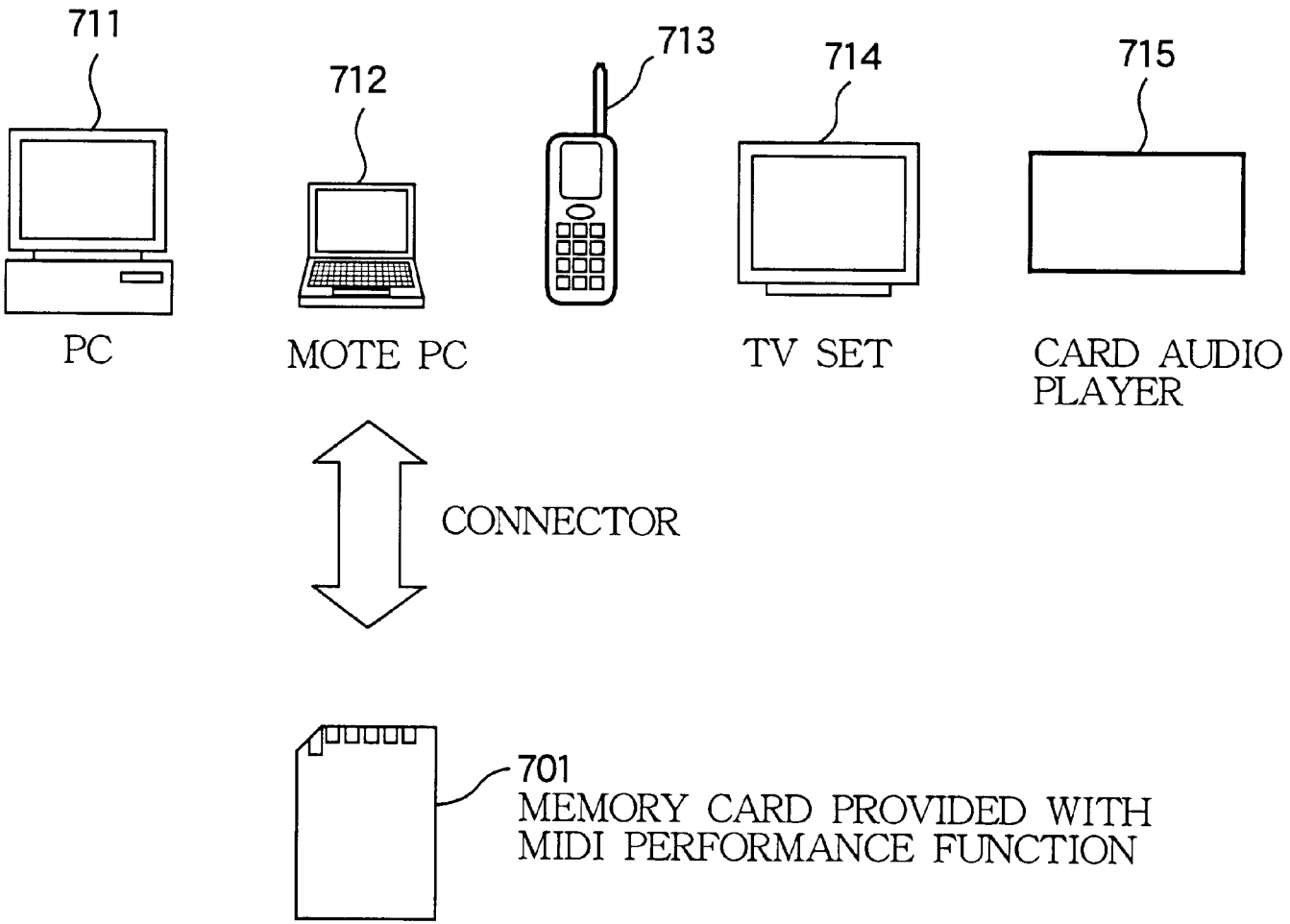
FIG. 7 is an illustration showing a configuration example of various apparatuses using a memory card provided with an MIDI performance function.

FIG. 7 shows an example of various electronic apparatuses using a memory card 701 provided with an MIDI performance function according to this embodiment. The MIDI performance function-equipped memory card 701 can be connected through a connector to a personal computer 711, a notebook-type personal computer 712, a portable telephone 713, a TV set 714, or any type of a card audio player 715. Generally, the electronic apparatus comprises a processor that can process the data stored in the memory card, a converter that converts waveform data fed from the memory card into music tones along with the processing of the data, and an input device such as a keyboard that can write control data into a control file stored in the memory card for controlling the reproduction of the music performance data.

Since the memory card 701 according to this embodiment is equipped with built-in MIDI sequencer and tone generator, those connectable electronic apparatuses 711–715 need not be equipped with the tone generator or the MIDI sequencer (software) to use the MIDI performance function as far as they are capable of reproducing music sounds by use of an ordinary audio file (i.e., as far as they can perform analog/digital conversion on a digital tone signal output from the memory card to then output an audio signal). Also, the memory card 701 can be instructed to reproduce, feed forward, rewind, pause, and stop the MIDI performance by writing to the control file to that effect, so that no special command is required.

Note here that this embodiment may employ any shape, mode, and specifications of.the memory card. Although the storage medium (memory core) of the memory card uses a nonvolatile memory such as a flash memory capable of read/write (erasure) operations, to store data of a music piece to be performed, the corresponding storage section may be made up of a ROM (Read Only Memory). If the user data can be allowed volatile, a RAM (Random Access Memory) can be used. Also, to use a flash memory, it is necessary to take into a service life into account. A RAM not limited in terms of service life can be used as a storage for storing files such as the WAVE buffer or control file, which are accessed to be read and written frequently.

This embodiment writes a file name (WAVEBUF0 or WAVEBUF1) of the WAVE buffer into the WAVEFILE of the output control file 118 alternately to make it difficult for the apparatus side to read out the thus written buffer. If the file system employs FAT management, the file name may be exchanged in a directory region (FIG. 3A) for defining the files WAVEBUF0 and WAVEBUF1 on the side of the tone generator section. Alternatively, the directory information of FIG. 3, i.e. the top cluster information pieces of the two buffers may be exchanged with each other ("2" and "5" are exchanged in FIG. 3A) to thereby exchange the buffer to be used. Further, another embodiment may exchange the information of extensions which are used to discriminate between the two WAVE buffers (FIG. 3B). Further, the apparatus side can always read out files having the same name so that the memory card side may exchange buffers to be accessed by that file name by reloading the directory as mentioned above.

Note here that although MIDI data in this specification refers to music performance data and so means performance data given in a format based on the MIDI (Musical Instrument Digital Interface) standard regulated and managed by such an organization of AMEI (Association of Musical Electronics Industry), which is a Japanese incorporated body, the music performance data in the embodiment of the present invention does not always refer to that of a format which conforms with the MIDI standard. It only needs to be of such a format that can be accommodated by the sequencer. In this specification, music performance data is expressed as MIDI data for convenience.

Also, the embodiment has employed, as an example, a double buffer mode in buffering of the musical-tone waveform data so that the file names WAVEBUF0 and WAVEBUF1 are alternately updated and output. The present invention is not limited to this embodiment; for example, two (or more) buffering file regions are reserved to thereby use file names such as WAVEBUF0, WAVEBUF1, WAVEBUF2, WAVEBUF3, . . . , each time the data is updated so that the butters may be recognized in terms of their mutual time-series relationship, thus enabling the external connectable apparatus side to recognize the files to be read out based on these file names in read-out operations of the music waveform data.

Also, although this embodiment sets the READY flag when there is present music waveform data or a WAVE file to be read out to the side of the external apparatus, when music waveform data is being written into the file region (during generation of music waveform data), the file name corresponding to the region may be changed or virtually deleted to provide a state that there is apparently no file to be read from the external apparatus side so that upon completion of write-in the original file name may be set. By this method, it is unnecessary to provide the READY flag because only music waveform data needs to be read out even if establishment of a file or a file name is detected.

Also, such performance operations as start (PLAY) or stop (STOP) of music performance can be controlled, besides by use of the control file, by inputting an extra command provided to the memory card.

The music waveform data written to the WAVE buffer may be of a non-compression linear format or any one of various data compression formats such as DPCM, ADPCM, or MPEG. Further, in addition to the encryption of data, such function may be given that disables utilization (reproduction, copy) except by an authorized external apparatus.

The data controller, the MIDI sequencer, and the tone generator may be independent of each other in their respective LSI chip configurations or otherwise integrated into a microprocessor. It is probably possible to integrate them into one chip including memories by using ever advancing integrated-circuit technologies of nowadays.

The tone generator section may be of any mode. It may be of FM, sampling waveform memory (PCM), or physical model mode, which can be selected according to the specifications.

Also, the tone generator section may be made up of a microprocessor or DSP (Digital Signal processor) so that a relevant tone-generator processing program may be supplied into the memory block from an external apparatus and then executed in the system. The MIDI sequencer may also be of the same system configuration.

Further, the storage device according to the present invention may be of any external appearances, besides a card shape, such as a box (pack), rod, or disk shape.

As described above, the present invention has an effect of incorporating a tone generator and a sequence function into a storage module such as a memory card to thereby easily. reproduce a MIDI performance only by inserting this storage device. Also, for example, a MIDI control operation to this storage device can be performed by writing a command to a control file having a predetermined file name, so that it is unnecessary to add a special command to the standard of various storage devices and also to change the standard nor the mode.

What is claimed is:

1. A functional storage module being removably connectable to an electronic apparatus as a storage medium of data, the electronic apparatus being external of the functional storage module, the functional storage module comprising:

a memory core block that stores various data including music performance data for use in adding a function of music performance to the electronic apparatus;

a sequencer block that retrieves the music performance data from the memory core block and that sequentially outputs instructions for synthesis of music tones according to the retrieved music performance data; and a tone generator block that operates in response to the instructions for carrying out the synthesis of the music tones, thereby outputting waveform data representative of the music tones to the electronic apparatus, wherein the electronic apparatus converts the waveform data into the music tones to thereby render music performance by the connection to the electronic apparatus.

2. The functional storage module of claim 1, further comprising a connector for removably connecting the functional storage module to the electronic apparatus.

3. The ftnctional storage module of claim of claim 2, further comprising an interface driver for transferring data between the functional storage module and the electronic apparatus through the connector.

4. The functional storage module of claim 2, wherein the electronic apparatus is one of a personal computer, a notebook-type computer, a portable telephone, a television receiver, and an audio playback device.

5. A functional storage module being removably connectable to an electronic apparatus as a removable storage medium of data, the electronic apparatus being external of the functional storage module, the functional storage module comprising:

a memory core block that stores various data including music performance data for use in adding a function of music performance to the electronic apparatus, the various data being stored in the form of files including a control file;

a controller block that operates when the electronic apparatus has written control data into the control file, for retrieving the control file from the memory core block to read the written control data;

a sequencer block that operates when the read control data designates music performance data and indicates reproduction thereof, for retrieving the designated music performance data from the memory core block, and for sequentially outputting instructions for synthesis of music tones according to the retrieved music performance data; and a tone generator block that operates in response to the instructions for carrying out the synthesis of the music tones, thereby outputting waveform data representative of the music tones to the electronic apparatus, wherein the electronic apparatus converts the waveform data into the music tones to thereby render music performance by the connection to the electronic apparatus.

6. The functional storage module according to claim 5, wherein the sequencer block operates when the control data indicates a control of the reproduction selected from a re-start, a stop, a fast feed, a rewind and a pause, for effecting the indicated control during the course of the reproduction of the music performance data.

7. The functional storage module of claim 5, further comprising a connector for removably connecting the functional storage module to the electronic apparatus.

8. The functional storage module of claim 7, further comprising an interface driver for transferring data between the functional storage module and the electronic apparatus through the connector.

9. The functional storage module of claim 7, wherein the electronic apparatus is one of a personal computer, a notebook-type computer, a portable telephone, a television receiver, and an audio playback device.

10. A system comprising an electronic apparatus and a storage module removably connectable to the electronic apparatus, the electronic apparatus being external of the functional storage module, the functional storage module, wherein the storage module comprises:

a memory core block that stores data including music performance data for use in adding a function of music performance to the electronic apparatus;

a sequencer block that retrieves the music performance data from the memory core block that sequentially outputs instructions for synthesis of music tones according to the retrieved music performance data; and a tone generator block that operates in response to the instructions for generating waveform data representative of the music tones, and wherein the electronic apparatus comprises:

a processor that can process the data stored in the storage module; and a converter that converts the waveform data fed from the storage module into the music tones along with the processing of the data to thereby render music performance by the connection to the electronic apparatus.

11. The functional storage module of claim 10, further comprising a connector for removably connecting the functional storage module to the electronic apparatus.

12. The functional storage module of claim 11, further comprising an interface driver for transferring data between the functional storage module and the electronic apparatus through the connector.

13. The functional storage module of claim 11, wherein the electronic apparatus is one of a personal computer, a notebook-type computer, a portable telephone, a television receiver, and an audio playback device.

14. A system comprising an electronic apparatus and a storage module removably connectable to the electronic apparatus, the electronic apparatus being external of the functional storage module, the functional storage module, wherein the storage module comprises:

a memory core block that stores data including music performance data for use in adding a function of music performance to the electronic apparatus, the data being stored in the form of files including a control file;

a controller block that operates when the electronic apparatus has written control data into the control file, for retrieving the control file from the memory core block to read the written control data;

a sequencer block that operates when the read control data designates music performance data and indicates reproduction thereof, for retrieving the designated music performance data from the memory core block, and for sequentially outputting instructions for synthesis of music tones according to the retrieved music performance data; and a tone generator block that operates in response to the instructions for generating waveform data representative of the music tones, and wherein the electronic apparatus comprises:

a processor that can process the data stored in the storage module;

a converter that converts the waveform data fed from the storage module into the music tones along with the processing of the data; and an input device that can write the control data into the control file stored in the storage module for controlling the reproduction of the music performance data.

15. The system according to claim 14, wherein the input device of the electronic apparatus can write the control data indicating a control of the reproduction selected from a re-start, a stop, a fast feed, a rewind and a pause for controlling the sequencer of the storage module to effect the indicated control during the course of the reproduction of the music performance data.

16. The functional storage module of claim 14, further comprising a connector for removably connecting the functional storage module to the electronic apparatus.

17. The functional storage module of claim 16, further comprising an interface driver for transferring data between the functional storage module and the electronic apparatus through the connector.

18. The functional storage module of claim 16, wherein the electronic apparatus is one of a personal computer, a notebook-type computer, a portable telephone, a television receiver, and an audio playback device.

* * * * *